US007521852B2

(12) United States Patent
Choi et al.

(10) Patent No.: US 7,521,852 B2
(45) Date of Patent: Apr. 21, 2009

(54) ELECTRODELESS LIGHTING SYSTEM

(75) Inventors: Joon-Sik Choi, Seoul (KR); Yong-Seog Jeon, Gyeonggi-Do (KR); Byeong-Ju Park, Seoul (KR); Hyun-Jung Kim, Seoul (KR); Yun-Chul Jung, Gyeonggi-Do (KR); Ji-Young Lee, Gyeonggi-Do (KR); Seung-Yeup Hyun, Jeju-Do (KR); Dae-Kyung Kim, Seoul (KR); Ri-Na Hwang, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 708 days.

(21) Appl. No.: 11/178,428

(22) Filed: Jul. 12, 2005

(65) Prior Publication Data

US 2006/0087257 A1 Apr. 27, 2006

(30) Foreign Application Priority Data

Oct. 26, 2004 (KR) ..... 10-2004-0085950

(51) Int. Cl.
*H01J 5/48* (2006.01)
*H01J 7/46* (2006.01)

(52) U.S. Cl. ..... 313/318.01; 313/49; 315/39

(58) Field of Classification Search ..... 315/39, 315/39.51, 39.53, 50, 248, 209 R, DIG. 3, 315/39.5; 313/317, 637, 634, 318.11, 318.12, 313/318.01, 49

See application file for complete search history.

(56) References Cited

U.S. PATENT DOCUMENTS

| | | | | |
|---|---|---|---|---|
| 6,049,170 | A * | 4/2000 | Hochi et al. | 315/39 |
| 6,617,806 | B2 * | 9/2003 | Kirkpatrick et al. | 315/248 |
| 6,661,183 | B2 * | 12/2003 | Park et al. | 315/248 |
| 6,734,638 | B2 * | 5/2004 | Kang et al. | 315/248 |
| 6,774,581 | B2 * | 8/2004 | Choi et al. | 315/248 |
| 7,276,860 | B2 * | 10/2007 | Choi et al. | 315/248 |

* cited by examiner

*Primary Examiner*—Douglas W. Owens
*Assistant Examiner*—Minh Dieu A
(74) *Attorney, Agent, or Firm*—Greenblum & Bernstein, P.L.C.

(57) ABSTRACT

An electrodeless lighting system comprises: a first case in which a microwave generator, a waveguide for guiding microwave energy and a luminous part communicating with the waveguide, for emitting light by the microwave energy are installed, wherein one side of the first case is opened so that light from the luminous part is emitted to the outside; a second case coupled to the first case to open or close the opened one side of the first case and configured to pass the light from the luminous part; and a third case positioned at one outer side of the first case, in which a high voltage generator for supplying a high voltage to the microwave generator is installed. Accordingly, in the electrodeless lighting system, lateral lighting can be made like a streetlight, heat generating components and lighting components can be installed at separated spaces, respectively, and the generated heat can be smoothly emitted to the outside.

19 Claims, 4 Drawing Sheets

ELECTRODELESS LIGHTING SYSTEM

BACKGROUND OF THE INVENTION

1. Field of the Invention

The present invention relates to an electrodeless lighting system, and particularly, to an electrodeless lighting system capable of lateral lighting like a streetlight and configured to smoothly emit the internally generated heat to the outside.

2. Description of the Background Art

As a conventional lighting system used for lateral lighting like a streetlight, a high pressure mercury lamp, a high pressure sodium or a metal halide lamp of 400 W or 250 W are commonly used. A structure thereof is shown in FIG. 1.

As shown in FIG. 1, a conventional streetlight includes: a casing 3 composed of an upper case 1 and a lower case 2; an arm 4 for fixing the casing 3 to a pole (not shown); a reflector 5 installed in the upper case 1; a lamp 11 installed inside the reflector 5; a receptacle 6 for fixing the lamp 11; and a ballast 7 connected to the lamp 11 by a power line 12 to stably apply power to the lamp 11.

A transparent cover 8 is installed at the lower case 2 so that light coming out of the lamp 11 can be transmitted therethrough. Also, the lower case 2 is hingeably connected to the upper case 1, and may be coupled to or disjointed from the upper case 1 by a clamp 10 installed at a front end portion of the upper case 1.

However, the lamp 11 used for the conventional streetlight as above has problems that its life span is very short, which causes frequent replacement, and its lighting effect is very low.

Therefore, recently, many researchers are performing various researches related to technologies of employing an electrodeless lighting system using plasma having advantages of a long life span of a lamp and good lighting effect, and related prototypes are being made.

Such an electrodeless lighting system is a lighting device in which microwave energy generated from a magnetron, a power source, is transmitted to a resonator through a waveguide, and is applied to an electrodeless bulb installed in the resonator, and thus the bulb emits visible light or ultraviolet light. The electrodeless lighting system has a long life span and good lighting effect compared with incandescent lamps and fluorescent lamps that are generally used. However, the electrodeless lighting system used for lateral lighting such as a streetlight whose technology is open or which is released as products is great in size because it employs a forced air cooling method using a cooling fan to cool heat generated from components. For this reason, it is difficult to make its structure compact and simple.

In addition, the conventional electrodeless lighting system also has a problem that a noise is generated due the driving of the cooling fan and the air flow due to the driving thereof.

SUMMARY OF THE INVENTION

Therefore, an object of the present invention is to provide an electrodeless lighting system capable of lateral lighting like a streetlight and configured to smoothly emit generated heat to the outside, in which heat generating components and lighting components are installed at separated spaces, respectively.

To achieve these and other advantages and in accordance with the purpose of the present invention, as embodied and broadly described herein, there is provided an electrodeless lighting system comprising: a first case in which a microwave generator, a waveguide for guiding microwave energy and a luminous part communicating with the waveguide, for emitting light by the microwave energy are installed, wherein one side of the first case is opened so that light from the luminous part is emitted to the outside; a second case coupled to the first case to open or close the opened one side of the first case and configured to pass the light from the luminous part; and a third case positioned at one outer side of the first case, in which a high voltage generator for supplying a high voltage to the microwave generator is installed.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a unit of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

A plurality of embodiments of an electrodeless lighting system in accordance with the present invention may exist, and, hereinafter, the most preferred embodiment will be described.

Figure 1:
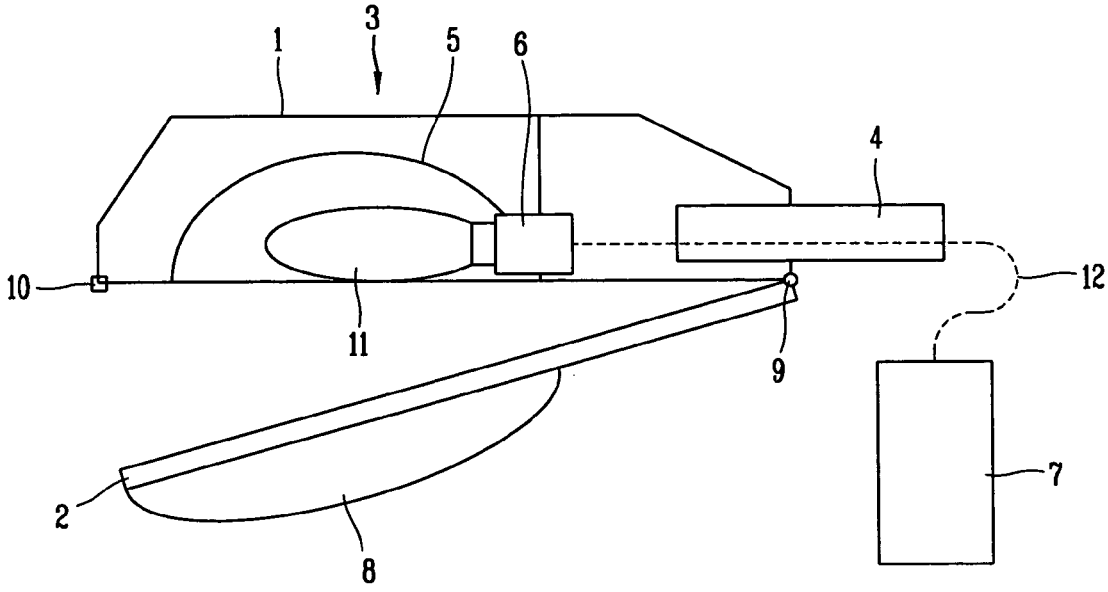
FIG. 1 CONVENTIONAL ART
FIG. 1 is a longitudinal sectional view schematically showing a conventional streetlight system.
Figure 2:
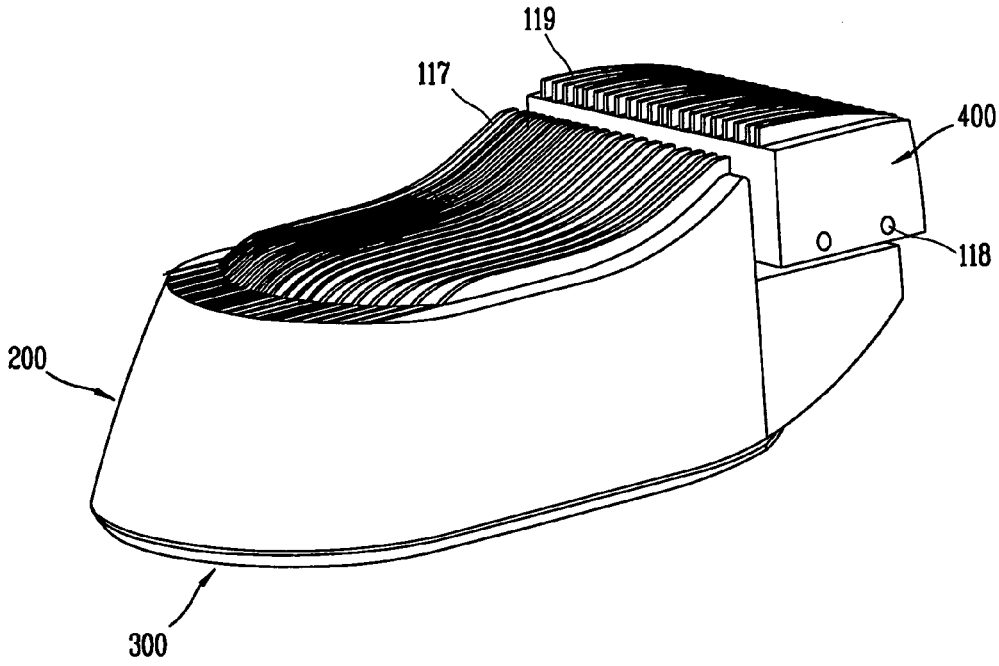
FIG. 2 is a perspective view showing an electrodeless lighting system in accordance with one embodiment of the present invention.
Figure 3:
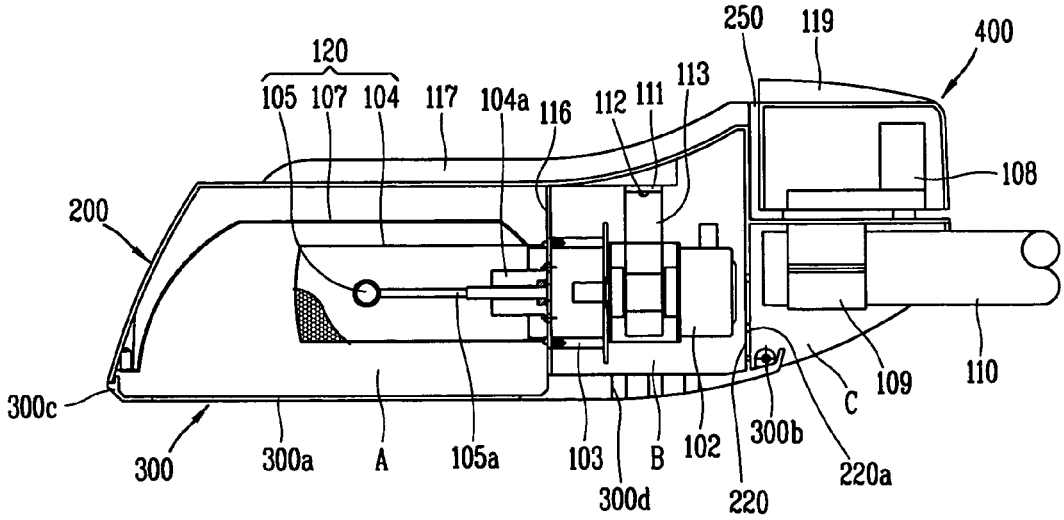
FIG. 3 is a longitudinal sectional view of FIG. 2.
Figure 4:
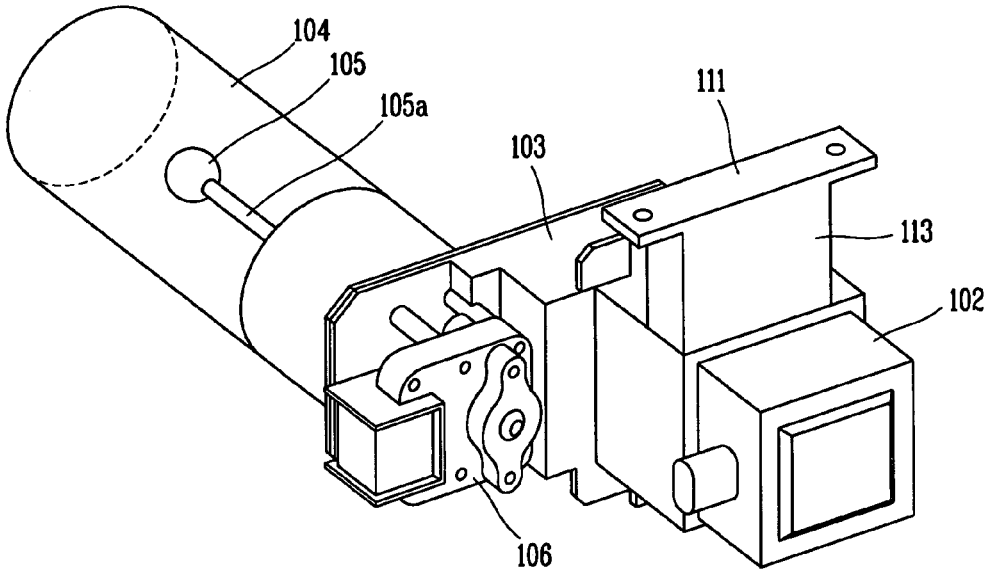
FIG. 4 is a perspective view showing an assembly composed of a luminous part, a waveguide and a microwave generator in accordance with the present invention.

FIG. 2 is a perspective view showing an electrodeless lighting system in accordance with one embodiment of the present invention, FIG. 3 is a longitudinal sectional view of FIG. 2, and FIG. 4 is a perspective view showing an assembly composed of a luminous part, a waveguide and a microwave generator in accordance with the present invention.

As shown, the electrodeless lighting system in accordance with one embodiment of the present invention includes: a microwave generator 102; a waveguide 103 for guiding microwave energy; a first case 200 having therein a luminous part 120 communicating with the waveguide 103 and emitting light by microwave energy, and having one side opened so that light from the luminous part 120 can be emitted to the outside; a second case 300 coupled to the first case 200 to open or close the opened one side of the first case 1 and configured to pass light emitted from the luminous part 120; a third case 400 positioned at one side outside the case 200 and having therein a high voltage generator 108 for supplying a high voltage to the microwave generator 102.

The first case 200 is divided into a first area (A) at which the luminous part 120 is positioned, a second area (B) at which the microwave generator 102 and the waveguide 103 are positioned, and a third area (C) receiving a power cable (not shown) for supplying power to the high voltage generator 108 and the microwave generator 102, wherein an arm 110 for supporting the first case 200 is installed at the third area (C).

Here, the arm 110 is fixed by a bracket 109 formed at one side of the third area (C).

A plurality of radiation fins 117 are formed at one outer surface of the first case 200 where the first area (A) and the second area (B) are positioned in order to transfer heat generated from the luminous part 120 and the microwave generator 102 to the outside. Preferably, the plurality of radiation fins 117 are entirely formed at one surface opposite to the opened side of the first case 200. According to designs, the plurality of radiation fins 117 may be formed at the entire outer surface of the first case 200 except the opened one side of the first case 200.

The luminous part 120 includes: a resonator 104 having one end coupled to the waveguide 103 and configured to allow microwave energy introduced from the waveguide 103 to resonate therein and to allow the light to pass therethrough; a bulb 105 positioned to be inclined to a side opposite to one end of the resonator 104 connected to the waveguide 103 on the basis of the center of the resonator 104; and a reflector 107 installed at an inner surface of the first case 200, which faces the opened one side of the first case 200, for reflecting light emitted from the bulb 105 to the opened one side of the first case 200.

The bulb 105 is rotated by being connected to a motor 106 installed at the second area (B) of the first case 200 by a bulb rotating shaft 105*a*.

Also, to more effectively achieve lateral lighting like a streetlight, preferably, the bulb 105 passes the center of the resonator 104 and is positioned adjacent to one end opposite to another end of the resonator 104 coupled to the waveguide 103. Accordingly, the bulb rotating shaft 105*a* is preferably formed long enough to pass the center of the resonator 103.

Also, to more effectively concentrate the microwave energy on the bulb 105, a resonance control member 104*a* for controlling a resonant space in the resonator 104 is installed. The resonance control member 104*a* is installed such that the bulb rotating shaft 105 passes through its center.

The first area (A) and the second area (B) of the first case 200 are divided by a separate plate 116, and a hole through which the resonator 104 coupled to the waveguide passes is formed at the separate plate 116.

Also, portions of the separate plate 104 except the hole through which the resonator 104 passes are preferably sealed so as to prevent the air containing foreign substances from being introduced into the first area (A) from the second area (B).

Here, the separate plate 116 is formed integrally with the first case 200.

And, the separate plate 116 may be made of a member of a different material from that of the first case 200. At this time, the separate plate 116 is preferably made of an insulation member.

Meanwhile, the second area (B) and the third area (C) of the first case 200 are also divided by the separate plate 220, and a plurality of holes 220*a* through which the power cable passes are formed at the separate plate 220.

Although not shown in the drawing, the power cable is connected to the high voltage generator 108 and the microwave generator 102 through the third area (C) of the first case 200 from the outside.

Meanwhile, in order to transfer heat generated from the microwave generator 102 to the outside, a heat transfer member 113 for connecting the microwave generator 102 to an inner surface of the first case 200 is installed at the second area (B) of the first case 200.

At this time, the heat transfer member 113 is connected to an inner surface of the side where the radiation fin 117 of the first case 200 is formed. Namely, a connection portion 111 formed at one end of the heat transfer member 113 is fixed to an inner surface of the first case 200 by a bolt 112. Also, various methods for fixing the heat transfer member 113 to the first case 200 can be used.

The second case 300 is pivotably coupled to the first case 200. Namely, one end of the second case 300 is pivotably fixed to the third area (C) of the first case 200 by a pin 300*b*, and its other end is provided with a clamp 300*c* so that the second case 300 is separably coupled to a front end of the first area (A) of the first case 200.

Also, a transparent window 300*a* is mounted at a portion of the second case 300 covering the first area (A) of the first case 200 so that light coming out of the luminous part 108 is emitted to the outside.

In addition, a plurality of holes 300*d* are formed at the second case 300 to cool the microwave generator 102 by air. Namely, the holes 300*d* are formed at a portion of the second case 300, which covers the second area (B) of the first case 200.

As shown in FIGS. 2 and 3, the third case 400 in which the high voltage generator 108 is installed is mounted adjacent to the first case 200 at a certain distance.

At this time, an insulation member 250 is preferably installed between the third case 400 and the first case 200 in order to prevent heat generated from the high voltage generator 108 from being transferred to the inside of the first case.

Also, a plurality of radiation fins 119 are formed at one outer surface of the third case 400 in order to more effectively radiate heat which is generated from the high voltage generator 108 to the outside. Preferably, the radiation fins 119 may be formed on the entire outer surface of the third case 400.

Meanwhile, the third case 400 is configured to be separable from the first case 200 by a detachable member 118 formed at its one side.

Here, preferably, the first case 200, the second case 300 and the third case 400 are made of an aluminum material.

Hereinafter, an electrodeless lighting system in accordance with another embodiment of the present invention will now be described.

Here, descriptions on the same structure as that of one embodiment of the present invention described above will be omitted, and the same reference numerals designate like or corresponding parts.

Figure 5:
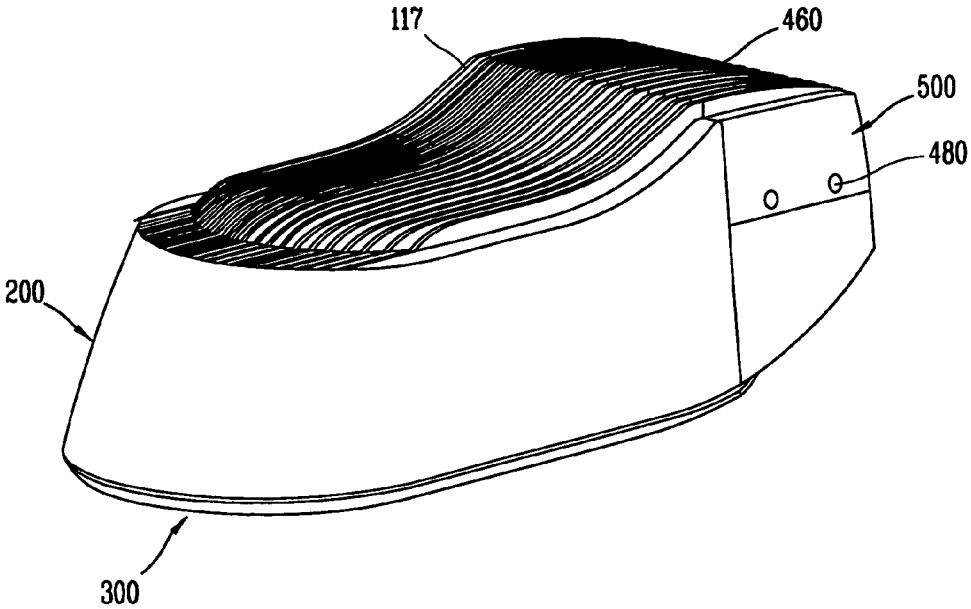
FIG. 5 is a perspective view showing an electrodeless lighting system in accordance with another embodiment of the present invention.
Figure 6:
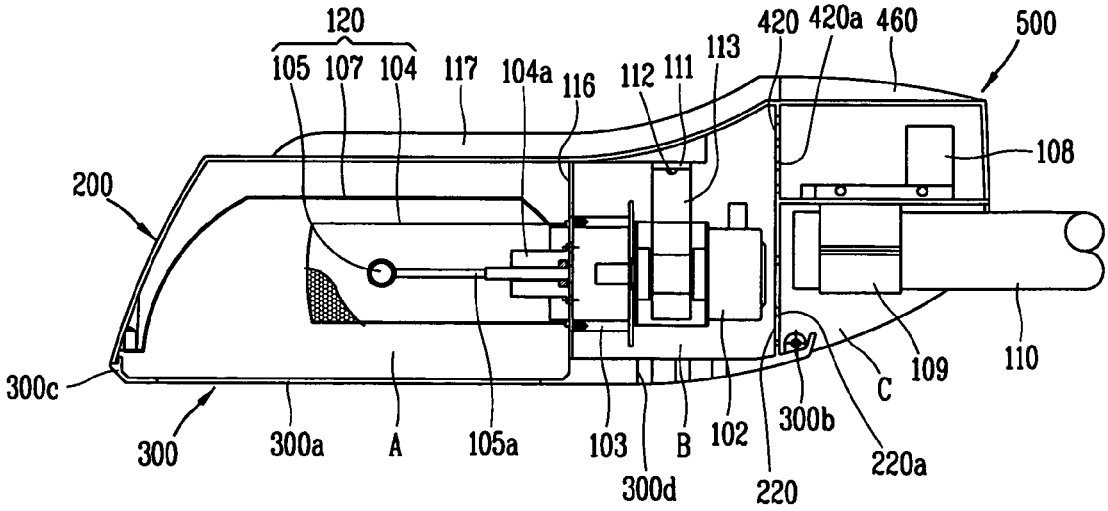
FIG. 6 is a longitudinal sectional view of FIG. 5.

FIG. 5 is a perspective view showing an electrodeless lighting system in accordance with another embodiment of the present invention, and FIG. 6 is a longitudinal sectional view of FIG. 5.

As shown, unlike the third case 400 according to one embodiment of the present invention, a third case 500 of an electrodeless lighting system in accordance with another embodiment of the present invention is closely attached to the first case 200.

At this time, the third case 50 and the second area of the first case 200 are divided by a separate plate 420. Preferably, the separate plate 420 extends from a separate plate 220 dividing the second area (B) and the third area (C) of the first case 200.

A plurality of holes 420 are formed at the separate plate 420. Accordingly, the inside of the third case 500 communicates with the outside through a plurality of holes 300*d* formed at a portion of the second case 300 covering the second area (B) of the first case 200 and the holes of the separate plate 420, so that the air cools not only the microwave generator 102 but also the high voltage generator 108.

Also, a plurality of radiation fins 460 are formed at one outer surface of the third case 500 so that heat generated from the high voltage generator 108 can be more effectively emitted to the outside. Preferably, the radiation fins 460 may be formed on the entire outer surface of the third case 400.

And, the radiation fins 460 formed at the third case 500 closely contact with radiation fins 117 formed at the first case 200, so that internal heat of the first case 200 and the third case 300 can be efficiently emitted to the outside.

Meanwhile, the third case 500 is configured to be separable from the first case 200 by the detachable member 480 formed at its one side.

Here, preferably, the third case 500 is also made of an aluminum material.

The operation of the electrodeless lighting system in accordance with the present invention will now be described.

When a high voltage generated from the high voltage generator 108 is supplied to the microwave generator 102, microwave energy is generated at the microwave generator 102. The microwave energy generated in such a manner is guided through the waveguide 103 and thus is introduced into the resonator 104 through a slot of the waveguide 103. And, the microwave energy introduced in the resonator 104 resonates therein and also excites a luminous material filled in the bulb 105. Accordingly, light due to plasma is generated, and the generated light passes the resonator 104 and is reflected by the reflector 107, thereby being emitted to the outside through an opened side of the first case 200.

At this time, as heat generating components such as the bulb 105, the microwave generator 102 and the high voltage generator 108 are positioned at separate areas, namely, in the first area (A) and the second area (B) of the first case 200, and the third case 400 and 500, respectively, heat interference therebetween is prevented. At the same time, the air is circulated between the inside of the cases 200 and 500 and the outside through a plurality of holes 300*d* and 420*a* formed at the separate plates 116, 220 and 420 for dividing the areas and at the second case 300 for opening/closing the first case 200, so that the heat can be easily diffused to the outside.

Particularly, the heat generated at the microwave generator 102 is transferred to the first case 200 through the heat transfer member 113 connected thereto, and the heat transferred to the first case 200 is easily emitted to the outside by heat exchange with the external air through a plurality of radiation fins 177 formed at the outer surface of the first case 200. Also, the heat generated from the high voltage generator 108 is also emitted to the outside through radiation fins 119 and 460 formed at the outer surface of the third case 400 and 500.

As so far described, in the electrodeless lighting system in accordance with the present invention, since heat generating components are positioned at separate areas and a separate plate that separates the components is made of an insulation material, heat interference therebetween is blocked, and thus a damage of the components can be prevented.

Also, the outside and inside of the case communicate with each other through a plurality of holes formed at separate plates for dividing the areas and the second case for opening/closing the first case, so that the air is circulated therebetween and thus the heat in the case can be easily diffused to the outside.

In addition, a plurality of radiation fins are formed at an outer side of the first case in which the luminous part and the microwave generator are installed and at an outer side of the third case in which the high voltage generator is installed, so that the generated heat can be more efficiently emitted to the outside.

Thus, the electrodeless lighting system in accordance with the present invention has the above described structure and effect, thereby being more effectively used in lateral lighting such as a streetlight.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. An electrodeless lighting system comprising:

a first case in which a microwave generator, a waveguide that guides microwave energy and a luminous part communicating with the waveguide, are installed, wherein one side of the first case is opened; and a second case coupled to the first case to open or close the opened one side of the first case, wherein the first case includes a first area at which the luminous part is positioned, and a second area at which the microwave generator and the waveguide are positioned; and a plurality of radiation fins are formed at one outer side of the first case at which the first area and the second area are positioned in order to transfer heat generated from the luminous part and the microwave generator to the outside.

2. The system of claim 1, wherein a heat transfer member that connects the microwave generator to an inner surface of the first case is installed at the second area of the first case in order to transfer heat generated from the microwave generator to the outside.

3. The system of claim 2, wherein the heat transfer member is connected to an inner surface of the side where the radiation fins of the first case are formed.

4. The system of claim 1, wherein the luminous part comprises:

a resonator having one end coupled to the waveguide and configured to allow the microwave energy introduced from the waveguide to resonate therein and to allow light to pass therethrough;

a bulb positioned to be inclined to a side opposite to one end of the resonator connected to the waveguide on the basis of the center of the resonator and emitting light by the microwave energy; and a reflector installed at an inner surface of the first case, which faces the opened one side of the first case, to reflect light coming out of the bulb to the opened one side of the first case.

5. The system of claim 4, wherein the first area and the second area are divided by a separate plate, and a hole through which the resonator connected to the waveguide passes is formed at the separate plate.

6. The system of claim 5, wherein the separate plate is formed integrally with the first case.

7. The system of claim 5, wherein the separate plate is made of a member of a different material from the first case.

8. The system of claim 7, wherein the separate plate is made of an insulation member.

9. The system of claim 1, the first case further includes a third area which has a power cable that supplies power to the microwave generator, wherein the second area and the third area are divided by a separate plate, and a plurality of holes through which the power cable passes are formed at the separate plate.

10. The system of claim 1, further comprising a third case positioned at outer side of the first case, in which a high voltage generator that supplies a high voltage to the microwave generator is installed, wherein a plurality of radiation fins are formed at one outer surface of the third case.

11. The system of claim 10, wherein the third case is closely attached to the first case.

12. The system of claim 11, wherein the third case and the second area of the first case are divided by a separate plate.

13. The system of claim 12, wherein a plurality of holes are respectively formed at a portion of the second case covering the second area of the first case and at the separate plate, and the external air is introduced through the holes so that the microwave generator and the high voltage generator are cooled.

14. The system of claim 10, wherein the third case is mounted adjacent to the first case at a certain interval.

15. The system of claim 14, wherein an insulation member is installed between the third case and the first case.

16. The system of claim 1, wherein a transparent window is mounted at a portion of the second case covering the first area of the first case so that light coming out of the luminous part is emitted to the outside.

17. The system of claim 1, wherein the second case is pivotably coupled to the first case.

18. The system of claim 1, wherein a plurality of holes are formed at the second case in order to cool the microwave generator by air.

19. The system of claim 1, wherein the first case and the second case are made of an aluminum material.

* * * * *